US009770614B1

(12) United States Patent
Sudeith

(10) Patent No.: US 9,770,614 B1
(45) Date of Patent: Sep. 26, 2017

(54) HAND HOLD ASSEMBLY

(71) Applicant: Everlast Climbing Industries, Inc., Mendota Heights, MN (US)

(72) Inventor: Timothy Sudeith, Edina, MN (US)

(73) Assignee: Everlast Climbing Industries, Inc., Mendota Heights, MN (US)

( * ) Notice: Subject to any disclaimer, the term of this patent is extended or adjusted under 35 U.S.C. 154(b) by 360 days.

(21) Appl. No.: 14/039,441

(22) Filed: Sep. 27, 2013

Related U.S. Application Data

(60) Provisional application No. 61/706,956, filed on Sep. 28, 2012.

(51) Int. Cl.
*A63B 21/00* (2006.01)
*A63B 9/00* (2006.01)

(52) U.S. Cl.
CPC ..... *A63B 9/00* (2013.01)

(58) Field of Classification Search
CPC ..... A63B 21/00
USPC ..... 482/35, 49; 242/591
See application file for complete search history.

(56) References Cited

U.S. PATENT DOCUMENTS 5,732,954 A 3/1998 Strickler et al.
5,944,634 A 8/1999 Neves
6,074,327 A 6/2000 Franklin
6,231,482 B1 5/2001 Thompson
6,402,663 B1 6/2002 Popp
6,514,178 B2 2/2003 Vettori
6,540,645 B1 4/2003 Zeilinger
D478,145 S 8/2003 Byrd et al.
6,709,365 B2 3/2004 Zeilinger
6,942,600 B2 9/2005 Zeilinger
D518,137 S 3/2006 Byrd et al.
D521,099 S 5/2006 Byrd et al.
7,250,020 B2 7/2007 Barbafieri et al.
7,360,739 B1 * 4/2008 Horvat ..... 242/591
7,520,837 B1 4/2009 Sudeith et al.
7,678,031 B2 * 3/2010 Ngu ..... 482/107
7,819,778 B1 10/2010 Sudeith et al.
7,862,480 B2 1/2011 Sudeith et al.
8,282,534 B1 10/2012 Sudeith et al.
2005/0245355 A1 11/2005 Brewer et al.
2007/0045334 A1 * 3/2007 Sherman et al. ..... 221/38
2008/0200318 A1 * 8/2008 Hauser et al. ..... 482/141

* cited by examiner

*Primary Examiner* — Andrew S Lo
(74) *Attorney, Agent, or Firm* — McAndrews, Held & Malloy, Ltd.

(57) ABSTRACT

A hand hold assembly designed for climbers with special needs. The hand hold assembly has a molded body structure with outwardly extending arms and a grab bar extending therebetween. The hand hold assembly has means for mounting the assembly on a climbing wall so that the grab bar may be disposed at various desired orientations. The grab bar may be textured, have a moisture absorbing layer or be illuminated.

15 Claims, 5 Drawing Sheets

HAND HOLD ASSEMBLY

This Application claims the benefit of U.S. Provisional Patent Application Ser. No. 61/706,956, filed on Sep. 28, 2012.

BACKGROUND OF THE INVENTION

The present invention relates generally to hand holds for climbing walls. Particularly, the invention relates to a hand hold assembly designed for use by youth with special needs. More particularly, the invention relates to a hand hold assembly that may be used with cooperating climbing wall structures and accessories by those with special needs.

Applicant's assignee is the holder of a number of U.S. Patents, namely, U.S. Pat. No. 7,046,266 for Climbing Wall Assembly, U.S. Pat. No. 7,381,154 for Heart Rate Monitors and Displays for Climbing Walls, U.S. Pat. No. 7,419,457 for Climbing Wall Assembly, U.S. Pat. No. 7,520,837 for Climbing Wall Assembly, U.S. Pat. No. 7,520,838 for Climbing Wall Route Setting Assembly and Process, U.S. Pat. No. 7,563,202 for Climbing Wall Assembly, U.S. Pat. No. 7,611,444 for Climbing Wall Assembly, U.S. Pat. No. 7,780,576 for Fitness System for Climbing Walls, U.S. Pat. No. 7,819,778 for Safety Mat Securement Assembly, U.S. Pat. No. 7,862,480 for Safety Mat Securement Assembly, U.S. Pat. No. 8,038,581 for Climbing Wall Assembly, and U.S. Pat. No. 8,282,534 for Safety Mat Securement Assembly. The aforementioned U.S. Patents disclose climbing wall structures, hand holds and related climbing wall accessories which are all incorporated by reference hereinto.

The present invention provides the benefits and advantages of rock climbing for children with special needs. Rock climbing may be a physically demanding activity requiring concentration, motor planning and sequential thought and thus a challenging activity to accommodate children with physical limitations or cognitive and sensory processing deficits. However, children with special needs can reap many benefits from indoor rock climbing activities. The hand hold assemblies and cooperating climbing accessories of the present invention allow for the inclusion and participation of children with disabilities in rock climbing activities.

SUMMARY OF THE INVENTION

The hand hold assembly of the invention is designed for use by youth with special needs. The hand hold assembly is designed to be used with cooperating climbing wall accessories to provide various benefits of rock climbing for children with special needs. For example, the hand hold assembly is designed for use by children with sensory disabilities, physical disabilities, cognitive disabilities, communicative disabilities and the like.

The hand hold assembly of the invention comprises a molded body structure with a flat surface for mounting to a climbing wall. The molded body structure has a pair of outwardly extending arm members with a grab bar extending between the terminal ends of the arm members. Means to mount the molded body structure to the surface of the climbing wall is provided and which permits the hand hold assembly to be mounted on the climbing wall with the grab bar disposed at various desired orientations.

The hand hold assembly may utilize a molded unitary body structure or a separable molded body structure. The outwardly extending arm members may be provided with opposing apertures to receive the grab bar for extension between the terminal ends of the arm members.

The grab bar may have a textured surface or be provided having moisture absorbing properties, such as by means of a coating or a laminated fabric layer to enhance the feel and grip of the grab bar structure. Further, the grab bar may be provided as an illuminated structure, such as a translucent polymeric tubular structure having LED lighting or the like positioned within or adjacent the translucent tubular grab bar structure.

The hand hold assembly may be provided in bright colors wherein the molded body structure and grab bar are of contrasting colors, for example, yellow and blue, respectively. The hand hold assembly may also be provided with a water spray nozzle and an associated activation button mounted on the hand hold assembly or adjacent thereto to provide a competitive climber with means to mist a climber to the side or below the hand hold. The water spray nozzle may also be utilized to clean the climbing wall, hand holds and other accessories mounted on the climbing wall. An activation button may also be mounted on the climbing wall itself, for example, to thereby activate a plurality of water spray nozzles mounted on the respective hand holds for climbing wall cleaning purposes.

An advantage of the invention is to provide a hand hold assembly conducive for use by children with disabilities.

Another advantage is to provide a hand hold assembly which is unitary or separable and having contrasting colors to aid children with visual limitations.

Another advantage is to provide hand hold assemblies having activatable spray nozzles for climber misting purposes and/or for climbing wall cleaning purposes.

Another advantage is to provide cooperating climbing related products including dry-erase and magnetic climbing wall surfaces that invite cognitive learning, creativity, visual interests, interaction and game play.

Another advantage is to provide cooperating ledge foot holds for successful foot placement.

Another advantage is to provide a hand hold assembly that allows for adjustability on the climbing wall and which provides a grab bar which may be textured for added stability and sense of control or be constructed of a moisture absorbent material to allow for a better grip.

These and other advantages of this invention will become clear from the following description by reference to the drawings.

DESCRIPTION OF THE PREFERRED EMBODIMENTS

Figure 1:
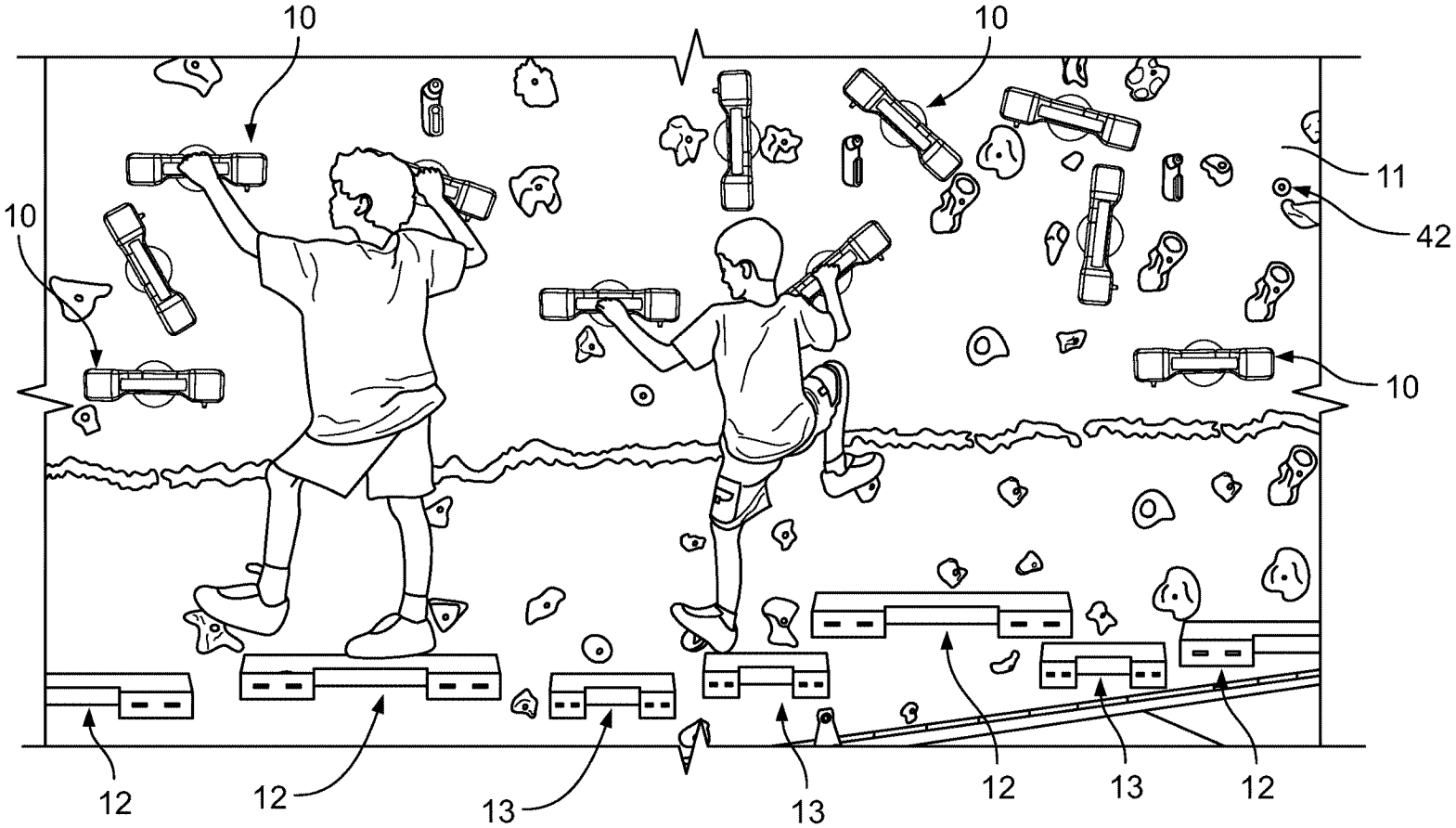
FIG. 1 is a frontal perspective view of a climbing wall having the hand hold assemblies of the invention mounted thereon.
Figure 2:
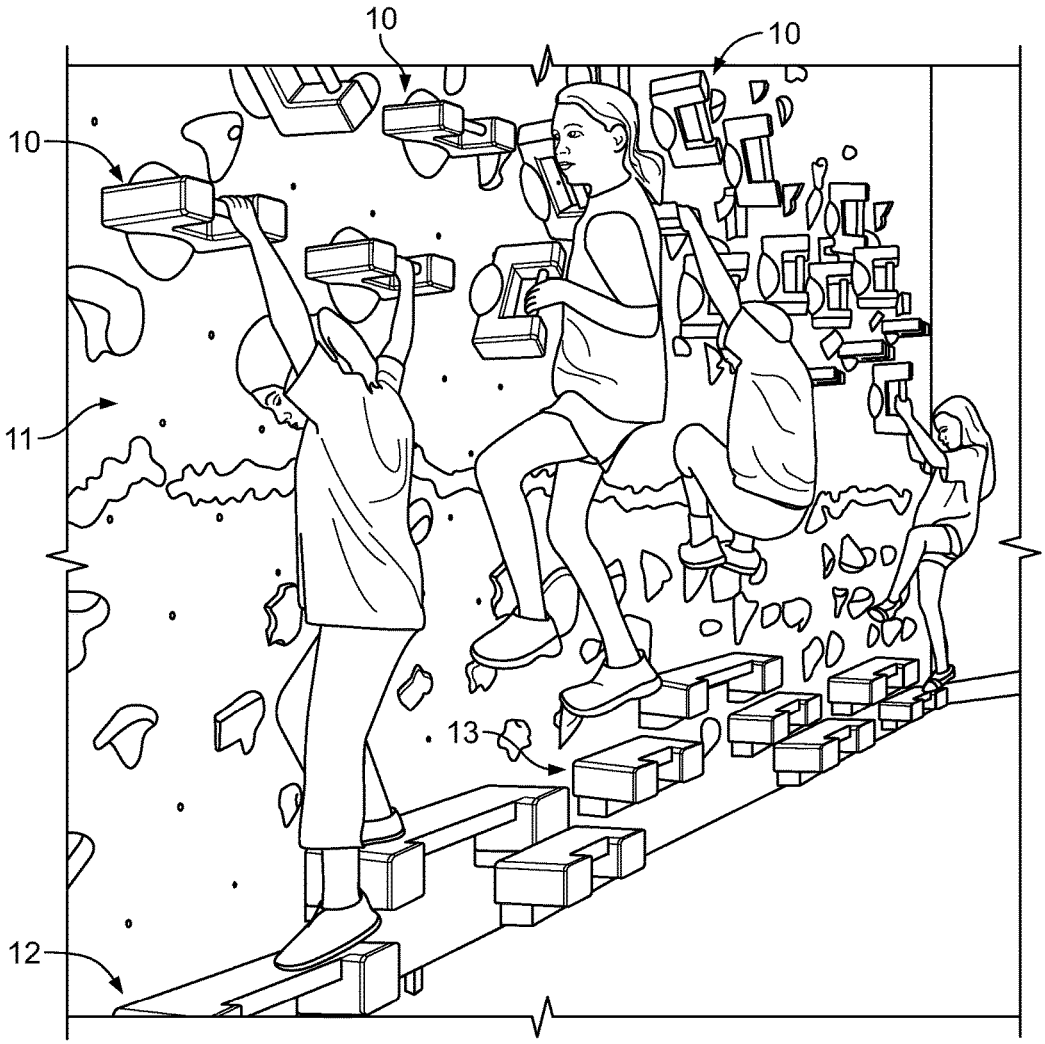
FIG. 2 is another perspective view showing the hand hold assemblies of the invention mounted on a climbing wall.

Referring to FIGS. 1 and 2, a plurality of hand hold assemblies 10 are shown mounted on climbing wall 11. The hand hold assemblies 10 are further shown to be used by climbers utilizing cooperating large and small footholds 12, 13. The latter footholds being mounted at various heights and the hand holds 10 being oriented in various directions on climbing wall 11. Specifically, the hand holds 10 each shown to have a grab bar which may be mounted in any desired direction and which are engaged by the climber during climbing activities. FIG. 1 is also shown to have a spray activator button 42, the function of which is further described below.

Figure 3:
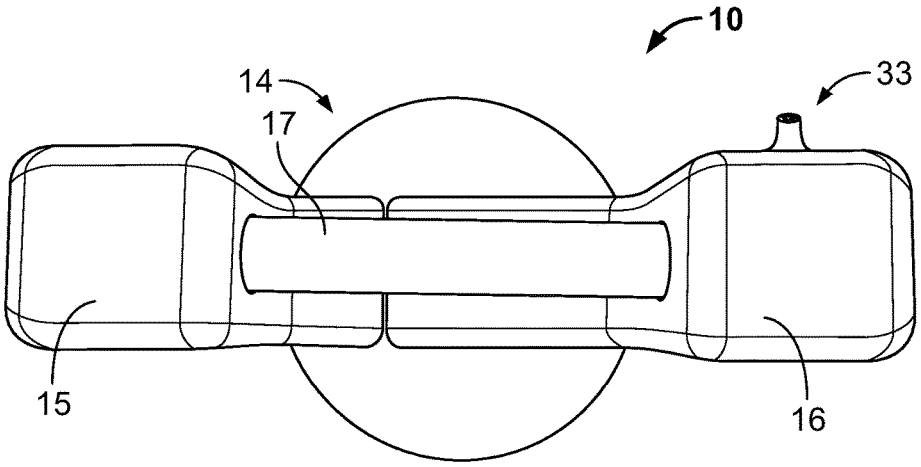
FIG. 3 is a top view of the hand hold assembly of the invention.
Figure 4:
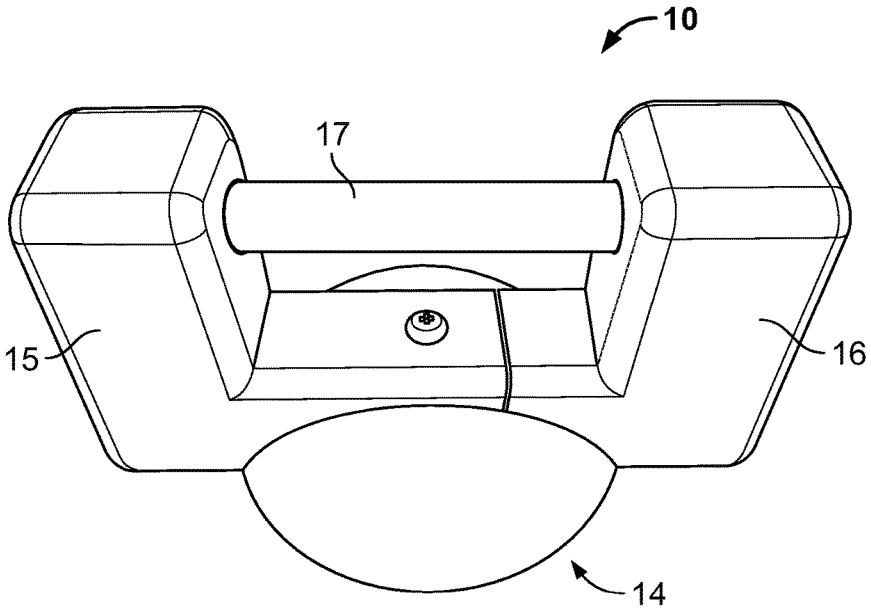
FIG. 4 is a perspective view of the hand hold assembly of FIG. 3.
Figure 5:
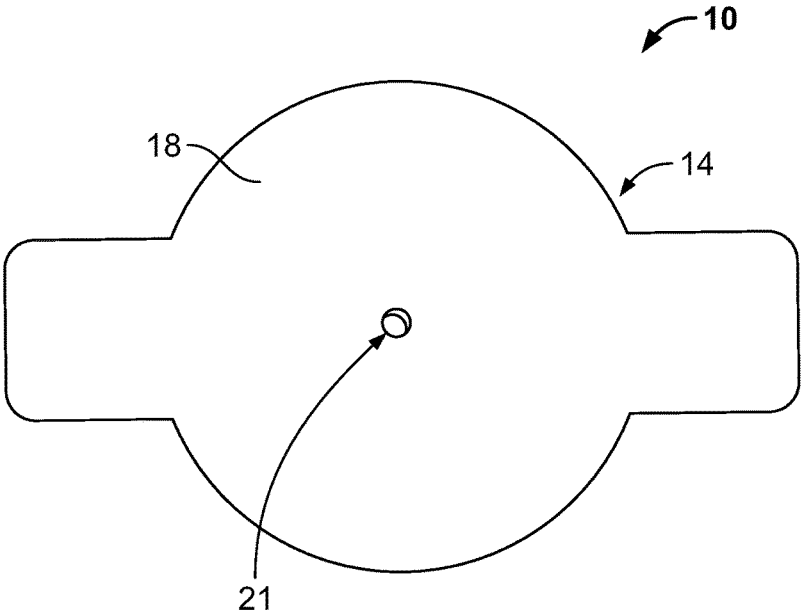
FIG. 5 is a bottom view of the hand hold assembly.

Referring to FIGS. 3-6, the hand hold assembly 10 is shown to be comprised of a molded body structure 14 having separable, generally L-shaped arm members 15, 16. Grab bar 17 is shown extending between arm members 15, 16. In FIG. 5, the molded body member 14 is shown to have a flat surface 18 for mounting via a fastener extending through bore 21 in the molded body member. FIG. 3 shows the hand hold assembly 10 having a spray nozzle 33 extending from arm member 16 and which is further described below.

Figure 6:
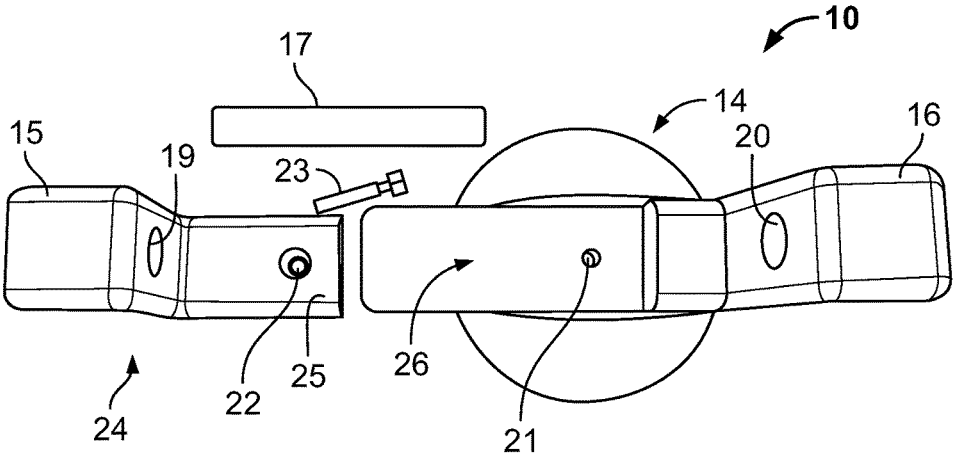
FIG. 6 is a top view showing the unassembled elements of the hand hold assembly of the invention.

Referring to FIG. 6, the hand hold assembly 10 is shown in an unassembled state to show its mating elements or parts. Specifically, the molded body member 14 is shown to have a semi-spherical base having a slotted portion 26 with bore 21. An offset arm member 16 is shown extending upwardly and having an aperture 20 at its terminal end. A molded L-shaped body structure 24 having arm member 15 is shown having a base portion 25 with bore 22 which aligns with bore 21 when the assembly is in a mating and assembled relationship whereby base portion 25 is positioned within slotted portion 26 of body structure 14 and whereby bore 22 is in alignment with bore 21. Bore 19 is shown at the terminal end of arm member 15 and is positioned to receive one end of grab bar 17 which is also held in opposing bore 20 of arm member 16 when the hand hold assembly 10 is in its assembled state and mounted to a climbing wall by means of a bolt member 23. The utilization of a single fastening member permits the hand hold assembly 10 to be mounted to a climbing wall 11 so that the grab bar 17 may be oriented in any desired direction, as shown in FIGS. 1 and 2.

The hand hold assembly 10 is shown to have a body structure with rounded or contoured corners and peripheries to provide for an easy and pleasant climbing experience. The molded body structure 14 may be molded of a bright colored polymeric material, i.e., bright yellow or other primary color and the grab bar 17 may be a formed of wood and have a bright blue color to provide contrasting colors with respect to a white climbing wall 11 to aid children with visual limitations, for example. The separable elements of the hand hold assemblies may also permit interchangeable color combinations to provide hand holds that may be utilized to establish climbing routes on a climbing wall.

Figure 7:
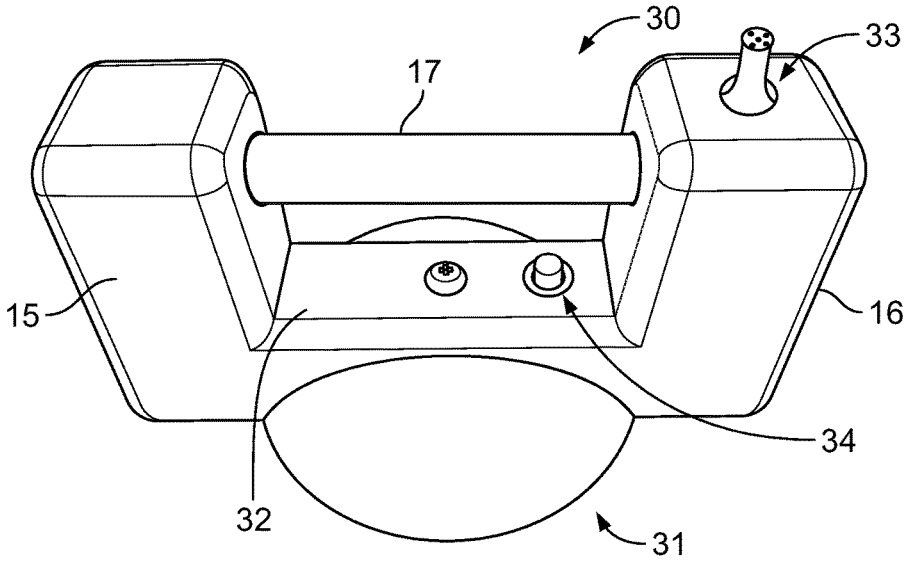
FIG. 7 is a perspective view of an alternate embodiment of the hand hold assembly of the invention.

As shown in FIG. 7, the hand hold assembly 30 is shown having a unitary body structure 31 with a base member 32. The unitary body structure 31 may be a molded polymeric structure as described above with respect to the separable molded body structure 14 of hand hold assembly 10. The hand hold assembly 30 is shown having a spray nozzle 33 and a cooperating activator button 34 mounted on base member 32. The spray nozzle 33 may be adjustable so that the spray or mist may be directed to a specified area with respect to the climbing wall. A communicating water source (not shown) may be provided on or through the body structure 31. The spray nozzle 33 and activator 34 may be provided on or in other locations of the body structure 31 of the hand hold assembly. The activation button 34 may be utilized by a climber to cause a spray mist to adjacent climbers or those below the hand hold assembly in a competitive climbing exercise. The spray nozzle 33 may also be utilized for purposes of cleaning the climbing wall and associated climbing elements. For example, activator button 42, shown in FIG. 1, may communicate with and activate a plurality of spray nozzles 33 so that all nozzles may be activated at once or sequentially for wall cleaning purposes. Connective tubing between a water source, the spray nozzle and activator buttons are not shown and are known in the art. The spray nozzle 33 shown in FIG. 3 may function in the same manner as described above.

Figure 8:
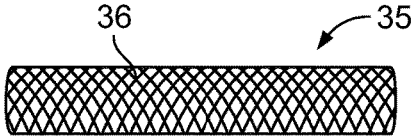
FIG. 8 is a frontal view of an alternate embodiment of the grab bar of the hand hold assembly.
Figure 9:
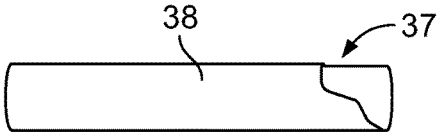
FIG. 9 is a frontal view of another embodiment of a grab bar structure.
Figure 10:
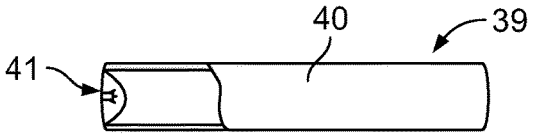
FIG. 10 is a frontal view of another embodiment of a grab bar structure.

The hand hold assemblies 10, 30 and cooperating foot holds 12, 13 are constructed to provide the stability and extra support that some participants need to be successful on a climbing wall. The hand hold assemblies 10, 30 provide a comfortable grab bar 17 that allows for a secure grip. Referring to FIG. 8, the grab bar 35 may have a textured surface 36 to change the feel and increase the grip of the grab bar. As shown in FIG. 9, the grab bar 37 may be constructed having a moisture absorbent material 38 to allow for a better and more comfortable grip. For example, the grab bar 37 may be provided with a moisture absorbing coating or a moisture absorbing fabric layer 38, as shown, the latter being laminated to or otherwise adhered to the exterior of the grab bar structure. As shown in FIG. 10, the grab bar 39 may also be provided having illuminating means 41. The grab bar 39 may be constructed of a polymeric translucent tubular structure 40 having LED or like lighting source 41 embedded or positioned therein. Associated power means (not shown) via AC or DC and activation means whether by direct or remote means may be utilized. The utilization of the moisture absorbing properties and/or the use of an illuminated grab bar 39 may further enhance the climbing experience of children with special needs.

As shown in FIGS. 1 and 2, the hand hold assemblies 10 or 30 can be mounted vertically, horizontally or at an angle for versatility. The cooperating foot holds 13, 12 provide a 5 inch deep ledges and lengths of 11 and 19 inches, respectively, and which help climbers maintain balance and lessen fatigue. The cooperating hand hold assemblies 10 and foot holds 12, 13 increase climbing wall accessibility for people with a variety of disabilities or mobility needs and may be mounted on Applicant's assignee's climbing wall panels as noted above.

An activity guide may also be provided to aid instructors to effectively include youth with special needs in climbing programs. As further disclosed in Applicant's assignee's patents, smooth dry-erase and magnet accepting surfaces can be written on and to accept magnetic objects. The grab bar style hand hold assemblies 10 and the cooperating ledge style foot holds 12, 13 provide stability and extra support and is ideal for adapted or inclusive physical education, occupational therapy and physical therapy and provides opportunities to develop balance, body awareness, muscle strength, motor planning and the like.

As many changes are possible to the hand hold assembly embodiments of this invention utilizing the teachings thereof, the descriptions above, and the accompanying drawing should be interpreted in the illustrative and not in the limited sense.

That which is claimed is:

1. A hand hold assembly comprising:

a) a molded body structure having a flat bottom surface mounted to a climbing wall;

b) two outwardly extending arm members, each having an aligned aperture; and c) a grab bar extending between said arm members and being held in said aligned apertures;

wherein the climbing wall comprises a plurality of hand holds spaced apart from one another in a manner that promotes climbing;

wherein a cooperating foot hold structure is mounted below said hand hold assembly.

2. The hand hold assembly of claim 1, wherein said molded body structure is formed of two separable and mating molded body members.

3. The hand hold assembly of claim 2, wherein said molded body structure is mounted to said climbing wall with a bolt member and wherein each of said separable and mating molded body members has a bore therethrough for receiving said bolt member.

4. The hand hold assembly of claim 3, wherein said molded body structure has a centrally disposed hemispherical configuration having said flat bottom surface and wherein said molded body structure has smooth contoured peripheral edges.

5. The hand hold assembly of claim 1, wherein said molded body structure has a first color and said grab bar has a second color and wherein said first and second colors are contrasting.

6. The hand hold assembly of claim 1, wherein said grab bar has a textured surface or a moisture absorbing surface.

7. The hand hold assembly of claim 1, wherein said molded body structure has a water spray nozzle, and a water supply connected thereto.

8. The hand hold assembly of claim 1, wherein said grab bar is formed of a translucent material and is configured for illumination.

9. A hand hold assembly comprising:

a) a molded body structure having a flat bottom for mounting to a climbing wall;

b) a pair of outwardly extending arm members, each having an opposing aperture;

c) a grab bar extending between said arm members and being held in said opposing apertures; and d) means to mount said molded body structure onto a climbing wall.

10. The hand hold assembly of claim 9, wherein said means to mount is a bolt member and wherein each of said separable and mating molded body members has a bore therethrough for receiving said bolt member.

11. The hand hold assembly of claim 9, wherein said molded body structure and said grab bar have contrasting colors.

12. The hand hold assembly of claim 9, wherein said grab bar has a textured surface or a moisture absorbing exterior.

13. An assembly comprising:

a hand hold assembly comprising a) a molded body structure having a flat bottom for mounting to a climbing wall;

b) a pair of outwardly extending arm members, each having an opposing aperture;

c) a grab bar extending between said arm members and being held in said opposing apertures; and d) means to mount said molded body structure onto a climbing wall; and a cooperating foot hold structure.

14. The hand hold assembly of claim 9, wherein said molded body structure has a water spray nozzle.

15. The hand hold assembly of claim 9, wherein said grab bar is formed of a translucent member and is configured for illumination.

* * * * *